US011118756B2

(12) United States Patent
An et al.

(10) Patent No.: US 11,118,756 B2
(45) Date of Patent: Sep. 14, 2021

(54) DIFFUSION LENS AND LAMP INCLUDING SAME

(71) Applicants: Hyundai Motor Company, Seoul (KR); Kia Motors Corporation, Seoul (KR); HYUNDAI MOBIS CO., LTD., Seoul (KR)

(72) Inventors: Seon-Yong An, Chuncheon-Si (KR); Kyoung-Chun Kweon, Seoul (KR); Hyun-Min Kim, Daegu (KR); Chae-Eun Son, Daegu (KR)

(73) Assignees: HYUNDAI MOTOR COMPANY, Seoul (KR); KIA CORPORATION, Seoul (KR); HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 16/853,057

(22) Filed: Apr. 20, 2020

(65) Prior Publication Data

US 2021/0247046 A1 Aug. 12, 2021

(30) Foreign Application Priority Data

Feb. 11, 2020 (KR) ..... 10-2020-0016234

(51) Int. Cl.

| | |
|---|---|
| ***F21V 5/04*** | (2006.01) |
| ***F21V 17/06*** | (2006.01) |
| ***F21Y 103/10*** | (2016.01) |
| ***F21Y 115/10*** | (2016.01) |

(52) U.S. Cl.

CPC ..... *F21V 5/04* (2013.01); *F21V 17/06* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,585,239 | B1 * | 11/2013 | Tseng | F21V 5/04 362/244 |
| 2011/0279751 | A1 * | 11/2011 | Iiyama | G02B 27/0955 349/64 |
| 2012/0307495 | A1 * | 12/2012 | Shih | G02B 19/0066 362/237 |
| 2013/0155690 | A1 * | 6/2013 | Chen | G02F 1/133603 362/311.02 |
| 2015/0041837 | A1 * | 2/2015 | Chinniah | F21V 29/713 257/98 |
| 2015/0103534 | A1 * | 4/2015 | Hu | F21V 5/04 362/311.07 |
| 2015/0109795 | A1 * | 4/2015 | Hu | F21V 5/04 362/308 |
| 2015/0117031 | A1 * | 4/2015 | Dai | F21V 5/04 362/335 |

(Continued)

FOREIGN PATENT DOCUMENTS

| | | |
|---|---|---|
| KR | 10-2012-0104599 A | 9/2012 |
| KR | 10-2018-0001791 A | 1/2018 |

*Primary Examiner* — Britt D Hanley

(74) *Attorney, Agent, or Firm* — Morgan, Lewis & Bockius LLP

(57) ABSTRACT

A diffusion lens may include a plurality of diffusion portions which contacts with an LED, is symmetrical to each other with respect to an optical axis which is a straight direction of the light emitted from the LED, and has convex surfaces.

18 Claims, 18 Drawing Sheets

(56) References Cited

U.S. PATENT DOCUMENTS

| | | | | |
|---|---|---|---|---|
| 2015/0276170 | A1* | 10/2015 | Motoyanagi | G02B 19/0061 362/335 |
| 2016/0061410 | A1* | 3/2016 | Jung | G02B 19/0066 362/334 |
| 2016/0161063 | A1* | 6/2016 | Yang | F21V 29/70 362/223 |
| 2016/0186959 | A1* | 6/2016 | Kim | F21V 5/04 362/311.02 |
| 2019/0178467 | A1* | 6/2019 | Woo | F21V 5/08 |
| 2020/0191356 | A1* | 6/2020 | Zozgornik | F21S 41/29 |

* cited by examiner

DIFFUSION LENS AND LAMP INCLUDING SAME

CROSS-REFERENCE TO RELATED APPLICATION

The present application claims priority to Korean Patent Application No. 10-2020-0016234, filed on Feb. 11, 2020, the entire contents of which is incorporated herein for all purposes by this reference.

BACKGROUND OF THE PRESENT INVENTION

Field of the Invention

The present invention relates to a diffusion lens and a lamp including the same.

Description of Related Art

Conventionally, a diffusion lens for an LED is mainly used in a backlight unit such as a liquid crystal display device or a TV to spread the light straightness of the LED at a wide angle in all directions so that light may be evenly distributed throughout a liquid crystal display panel. Accordingly, the diffusion lens for the LED is to implement a lighting device which does not generate bright spots and dark areas by diffusing the light.

However, a lamp for a vehicle usually is composed of the LED and a diffusion lens, and is a lamp which optimizes the number and spacing of the LEDs to provide a uniform linear image, and the diffusion lens among lamp components for the vehicle focuses on not only spreading the LED light at a wide angle but also spreading horizontally for implementing the line lighting.

As the related art on the diffusion lens, Patent Document 1 (Korean Patent Laid-Open Publication No. 10-2018-0001791) has a shape which is convex upwards from an emission surface in a vertical cross section on an LED as in FIG. 1, and uses an LED lens which is composed of a first convex portion and a second convex portion having a circular band shape in a plane. In addition, the Patent Document 1 has a structure in which the LED and the lens are composed of a 1:1 pair through a leg portion which is fastened to the lower portion thereof. The Patent Document 1 has a problem in that there exists a limit to the extent to which hot spot portions and dark portions near the optical axis of the LED are alleviated as in B of FIG. 2. In addition, the Patent Document 1 has a separate fastening portion for fastening a plastic lens and has an air gap which is formed in the LED portion.

As the related art on the diffusion lens, Patent Document 2 (Korean Patent Laid-Open Publication No. 10-2012-0104599) is a patent which relates to a retrofit-style lamp including a one-dimensional linear batwing lens which diffuses light as illustrated in FIG. 3 and FIG. 4. The present technology is composed of the linear batwing lens as in FIG. 3 having a shape in which the concave portion and the curved edge portion are symmetrical on the plurality of LEDs. The present technology has a problem in that one liner batwing lens is configured regardless of the number of the LEDs as in FIG. 4, not optimizing for the LED. In the case of the lamp for the vehicle, it is important to reduce the number of the LEDs and to implement the uniform linear image by use of the diffusion lens, but there is a problem in that the present technology is not focused on this. The light diffusion lens to be used in the vehicle lamp is inevitably a lens which spreads light horizontally, but when the technology of the Patent Document 2 is used, the light spreads regardless of the number and spacing of the LEDs, such that the vehicle lamp may not be uniform. In addition, the technology is composed of a plastic lens to require a separate fastening portion, which causes an air gap, resulting in optical loss.

In addition, until now, the related art uses a method of assembling the light diffusing lens having various shapes to diffuse the light of the LED in all of the liquid crystal display device or the linear lamp. Accordingly, there exist drawbacks in that not only the processing and manufacturing costs are increased but also the optical loss occurs due to the air gap between the LED and the lens.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a diffusion lens and a lamp including the same, which may reduce the optical loss, may also be applied to a curved substrate, and may efficiently diffuse light horizontally.

A diffusion lens according to various aspects of the present invention includes a plurality of diffusion portions which contacts with an LED, is symmetrical to each other with respect to an optical axis which is a straight direction of the light emitted from the LED, and has convex surfaces.

The convex surfaces of the diffusion portions are formed of two or more curved surfaces which have different centers of curvatures.

The convex surfaces of the diffusion portions include a first curved surface and a second curved surface which have different centers of curvatures, and a third curved surface between the first curved surface and the second curved surface, and is formed to be sequentially connected in one direction in an order of the first curved surface, the third curved surface, and the second curved surface from the optical axis Here, a curvature of the third curved surface is greater than a curvature of the first curved surface and a curvature of the second curved surface.

In addition, the curvature of the first curved surface is smaller than the curvature of the second curved surface.

Furthermore, an inflection surface, which is formed between the first curved surface, and a first curved surface of another diffusion portion neighboring to the first curved surface, and has a curvature opposite to the first curved surface, is formed.

Here, an angle ($\theta$1) between the highest points of the neighboring respective diffusion portions around the lowest point of the inflection surface is 5 degrees to 80 degrees.

In addition, when a height from the LED to the lowest point of the inflection surface is H1 and a height from the LED to the highest point of the diffusion portion is H2, H1:H2=1:1 to 2.

In addition, when a horizontal distance from the LED to the highest point of the diffusion portion is A and a horizontal distance from the LED to the end portion of the second curved surface is C, A:C=1:1 to 4.

Meanwhile, the convex surface of the diffusion portion may include a first curved surface and a second curved surface which have different centers of curvatures, a third curved surface between the first curved surface and the second curved surface, and a concave cut surface which has a curvature opposite to the first curved surface and the third curved surface between the first curved surface and the third curved surface.

Here, the convex surface of the diffusion portion may have a plurality of concave cut surface formed thereon.

Accordingly, the plurality of concave cut surfaces may be parallel to each other.

Alternatively, neighboring concave cut surfaces among the plurality of concave cut surfaces may be surface-symmetrical to each other.

Furthermore, an inflection surface, which is formed between the first curved surface, and a first curved surface of another diffusion portion neighboring to the first curved surface, and has a curvature opposite to the first curved surface, is formed.

Here, an angle (θ1) between the highest points of the neighboring respective diffusion portions around the lowest point of the inflection surface is 5 degrees to 80 degrees.

In addition, when a height from the LED to the lowest point of the inflection surface is H1 and a height from the LED to the highest point of the diffusion portion is H2, H1:H2=1:1 to 2.

In addition, when a horizontal distance from the LED to the highest point of the diffusion portion is A and a horizontal distance from the LED to the end portion of the second curved surface is C, A:C=1:1 to 4.

Furthermore, an angle (θ2) between the highest point of the diffusion portion and the highest point of the second curved surface around the lowest point of the concave cut surface is 7 degrees to 80 degrees.

In addition, when a height from the LED to the lowest point of the inflection surface is H1 and a height from the LED to the lowest point of the concave cut surface is H3, the H3 is the H1 or more.

Next, a lamp according to various aspects of the present invention includes a PCB substrate, an LED mounted to the PCB substrate, and a diffusion lens including a plurality of diffusion parts, which contact with the LED, are symmetrical to each other with respect to an optical axis which is a straight direction of the light emitted from the LED, and have convex surfaces.

Here, the material of the diffusion lens is a liquid silicone material (LSR).

Accordingly, an air gap does not exist between the diffusion lens and the LED.

In addition, the diffusion lens is formed integrally on the PCB substrate by injection.

Since the diffusion lens according to an exemplary embodiment of the present invention may be injection-manufactured by inserting the substrate on which an LED is mounted by the liquid silicon material (LSR), the air gap between the LED and the lens may be eliminated, and the separate adhesive agent is not needed, reducing the optical loss.

In addition, since the diffusion lens may be integrally injected, it may also be formed on the curved substrate, and it is possible to diffuse the light horizontally and excellently, performing the surface light emitting function as the vehicle lamp even by the minimum of LEDs.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
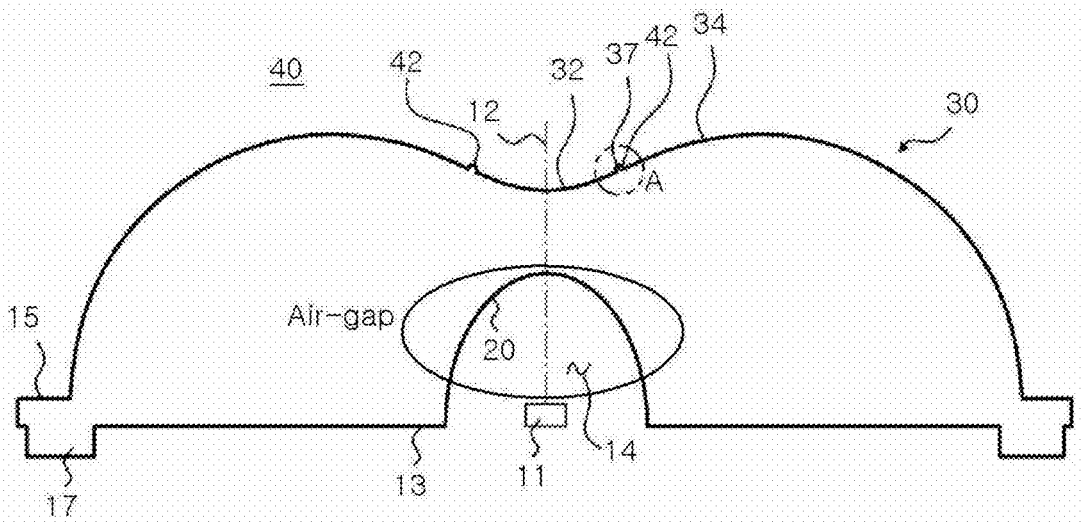
FIG.1 (Prior Art)
FIG. 1, FIG. 2, FIG. 3, and FIG. 4 are diagrams illustrating a diffusion lens according to the related art.
Figure 2:
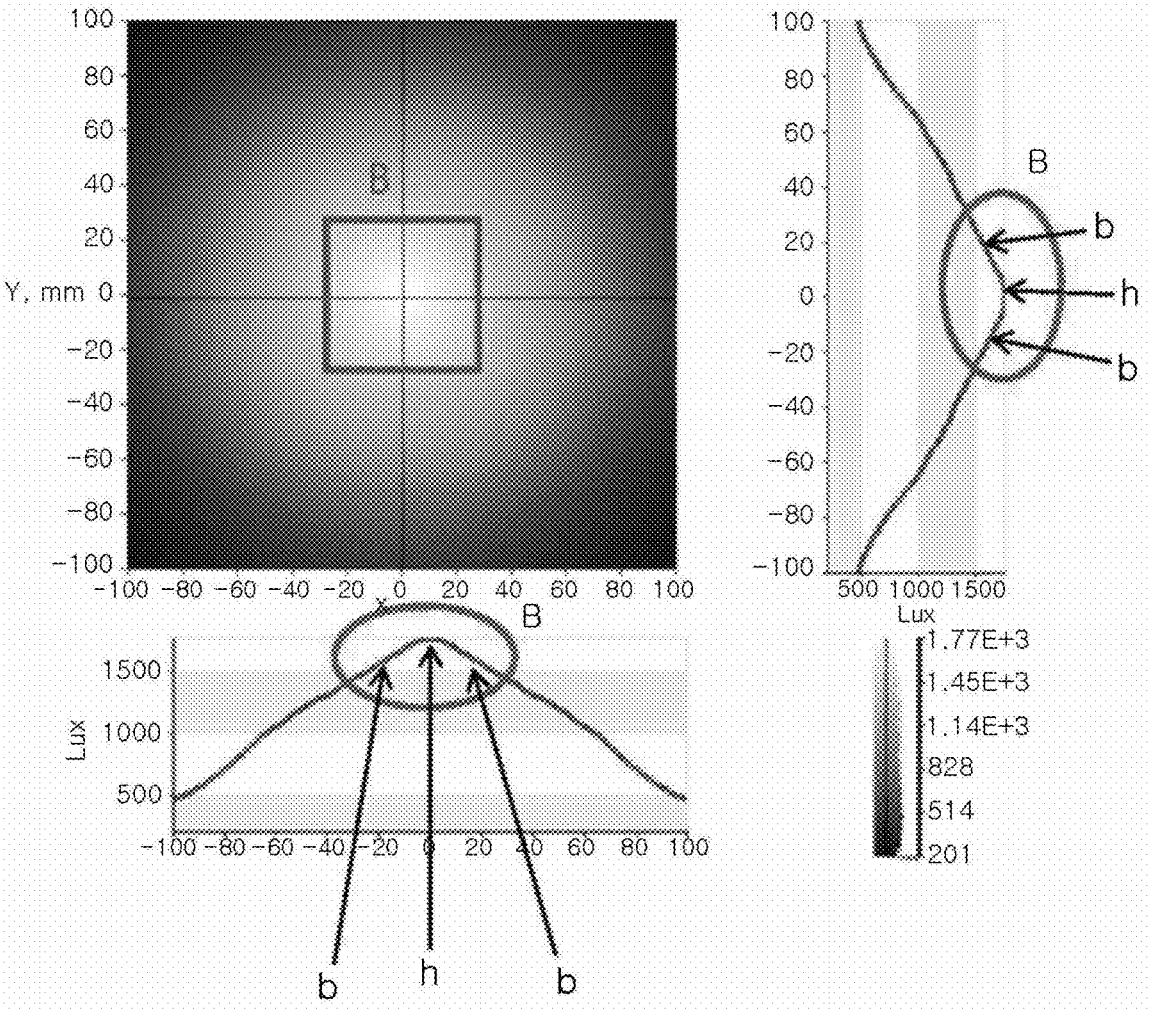
FIG.2(Prior Art)
Figure 3:
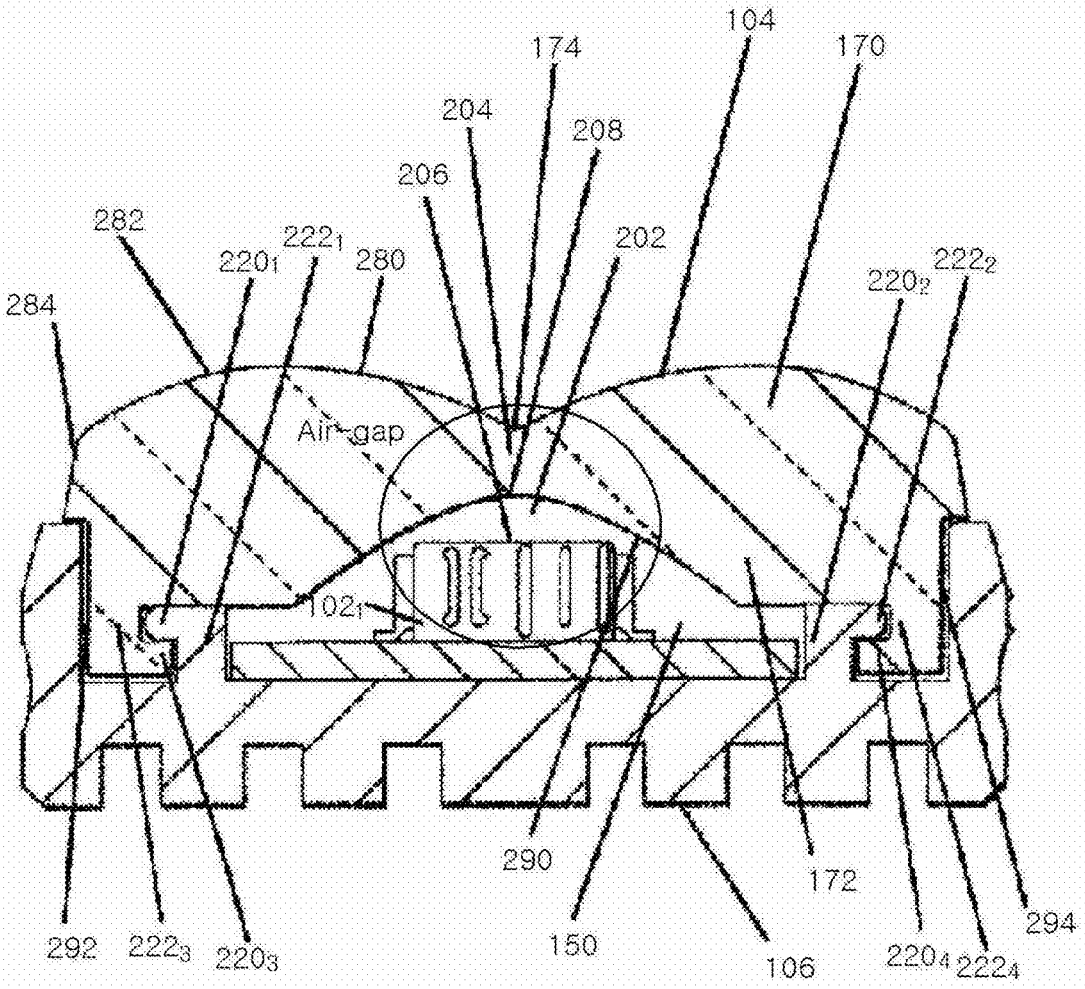
FIG.3 (Prior Art)
Figure 4:
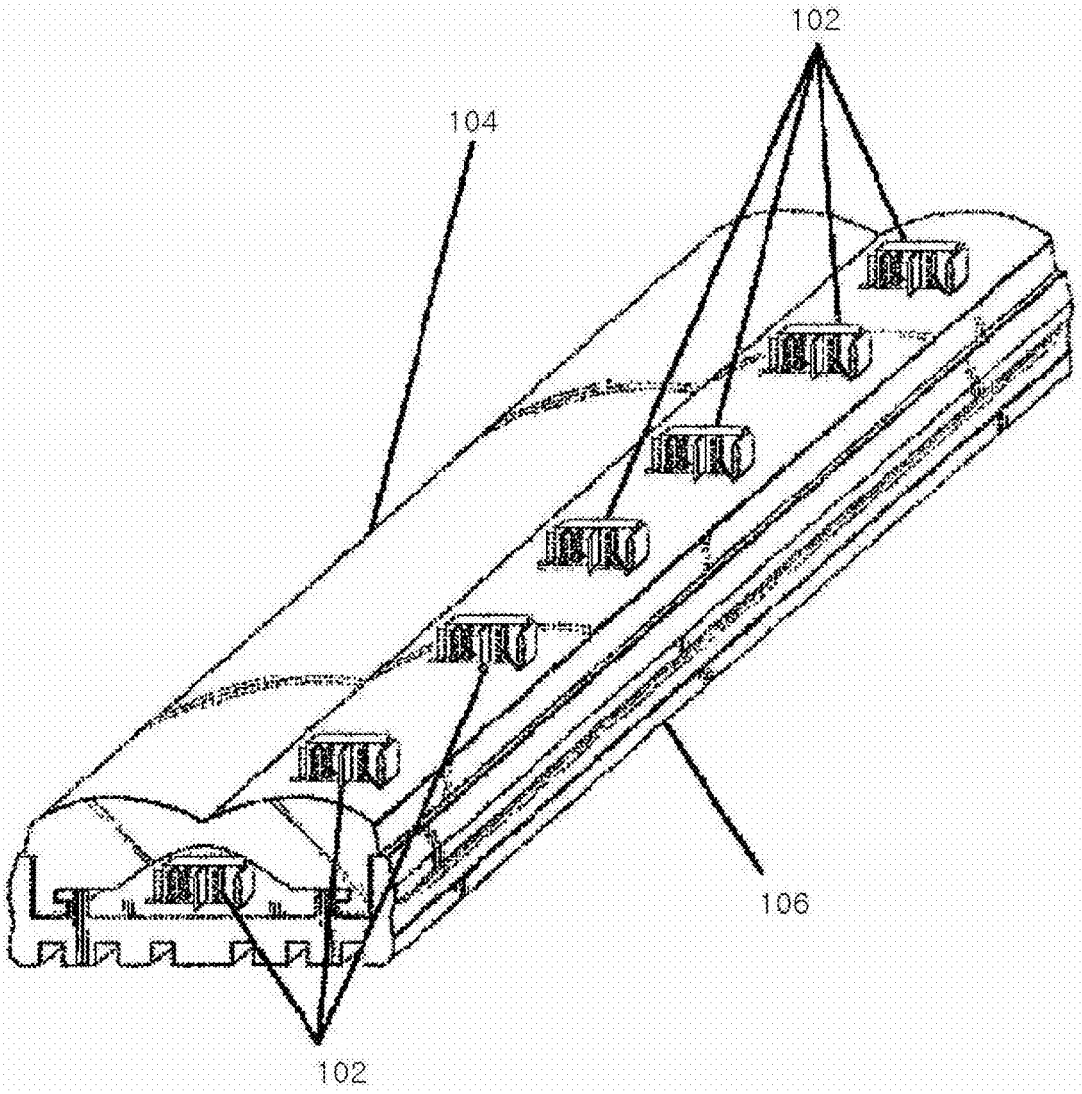
FIG.4 (Prior Art)

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the contrary, the present invention(s) is/are intended to cover not only the exemplary embodiments of the present invention, but also various alternatives, modifications, equivalents and other embodiments, which may be included within the spirit and scope of the present invention as defined by the appended claims.

To fully understand the present invention, the operational advantages of the present invention, and the objects achieved by practicing the present invention, reference may be made to the accompanying drawings which illustrate exemplary embodiments of the present invention and the contents described in the accompanying drawings.

In describing the exemplary embodiments of the present invention, well-known technologies or repeated descriptions which may unnecessarily obscure the subject matter of the present invention will be shortened or omitted.

Figure 5:
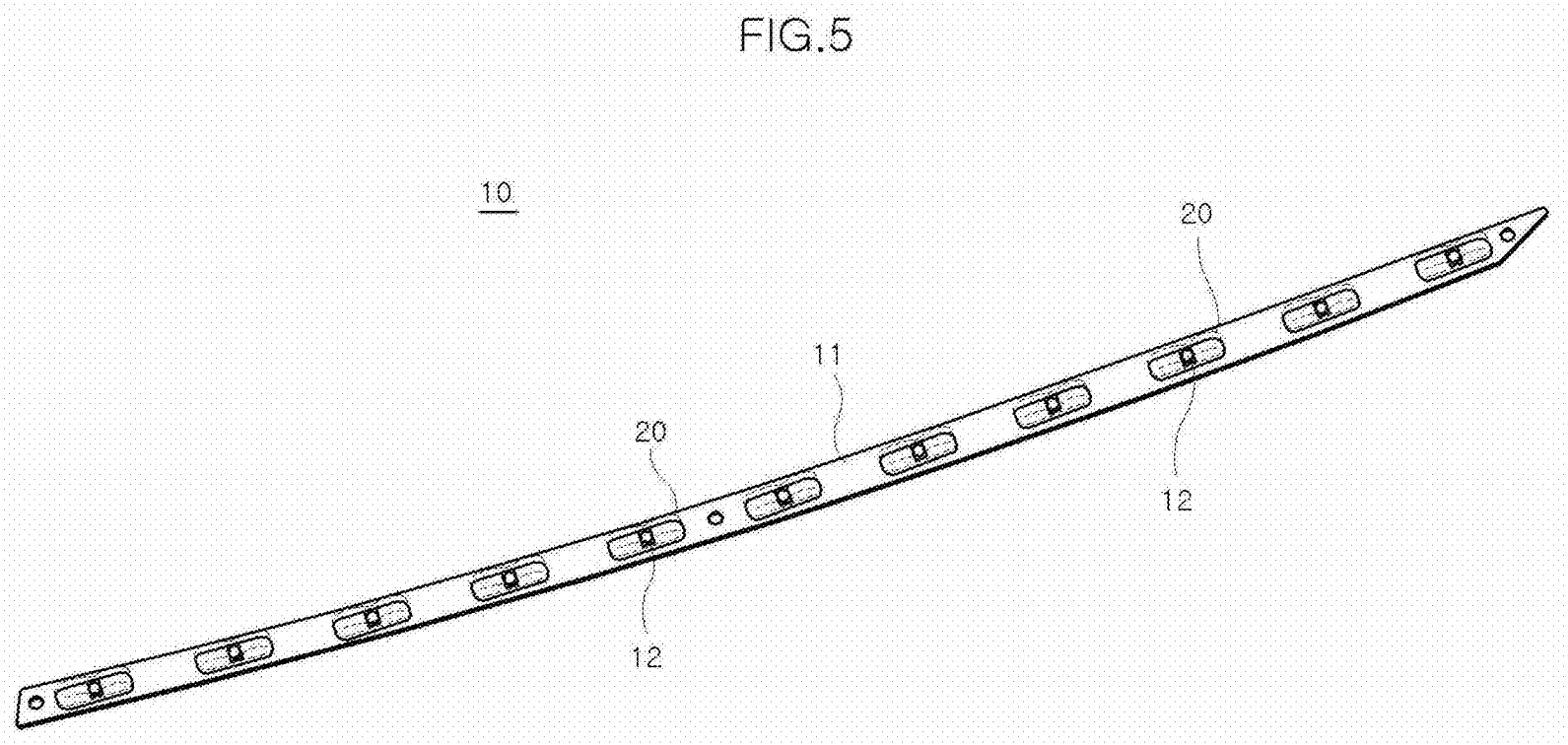
FIG. 5 is a diagram illustrating a lamp according to an exemplary embodiment of the present invention.
Figure 6:
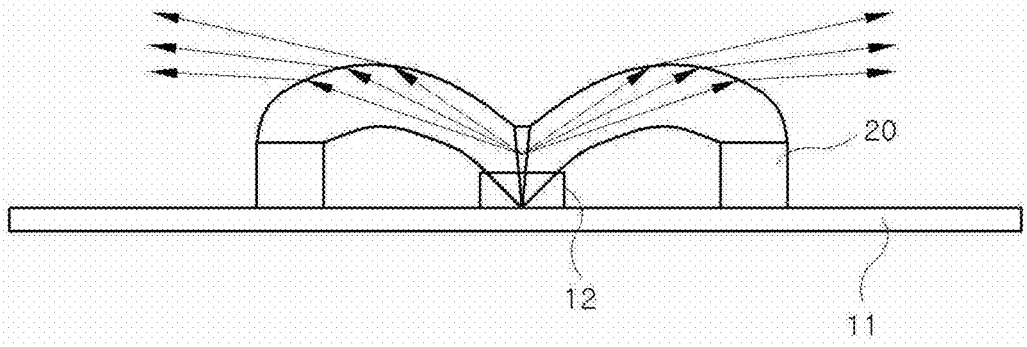
FIG. 6 is a diagram conceptually illustrating a diffusion lens according to an exemplary embodiment of the present invention.

FIG. 5 illustrates a lamp according to an exemplary embodiment of the present invention, and FIG. 6 conceptually illustrates a diffusion lens according to an exemplary embodiment of the present invention.

A lamp 10 according to an exemplary embodiment of the present invention includes a PCB substrate 11, an LED 12 which is mounted on the PCB substrate 11, and a diffusion lens 20 which is laminated and coupled on the LED 12 and the PCB substrate 11, and diffuses the light emitted from the LED 12.

The diffusion lens 20 according to an exemplary embodiment of the present invention is injected by mixing the material which includes a primary material and a curing agent at a ratio of 1 to 3:1 by use of a liquid silicone material (LSR). When the thermosetting lens, which is rapidly cured by the reaction between the primary material and the curing agent, is manufactured, there does not largely damage to the LED even when the PCB mounted with the LED is placed in the mold to directly inject the thermosetting lens. Accordingly, since the LED and the silicon material are injected in close contact with each other, air gaps do not occur and optical loss may be reduced, increasing the amount of light. On the other hand, since the injection using the conventional plastic material uses the thermoplastic resin, the LED may be exposed for a long time at a high mold temperature, being damaged. In addition, since the conventional technology is referred to as the plastic lens and has the separate fastening portion, it is easy to fasten only to a flat substrate, but the present technology is also applicable to a substrate having curvature as well as the flat plate because the lamp is formed by injecting silicon.

In addition, by injecting the diffusing lens 20 to the PCB substrate 11 on which the LED 12 is mounted, it is possible to not only inject the diffusing lens 20 on each of the LEDs 12 but also configure the diffusion lens 20 in an aspheric shape as in FIG. 6, widely spreading the linearity of LED light and horizontally diffusing the light.

In addition, the conventional diffusion lens has been mainly a structure in which the fastening portion is manufactured separately to be fastened on the LED, and has been required to be attached to the upper portion of a chip with an adhesive agent, and has used the plastic material. However, the diffusion lens according to an exemplary embodiment of the present invention does not use the separate fastening portion and may have no air gap, reducing the optical loss and horizontally diffusing the light, and may implement the surface light emitting structure which may implement the curved surface, being applied to the vehicle lamp design curved surface.

The diffusing lens according to an exemplary embodiment of the present invention is a lens having an improved diffusing performance to serve as a vehicle lamp. To this end, by implementing the diffusion lens in an aspheric shape or the like as described later, it is possible to improve the diffusion performance, and such design degree of freedom is possible because the injection molding is made by applying the liquid silicone material.

Figure 7:
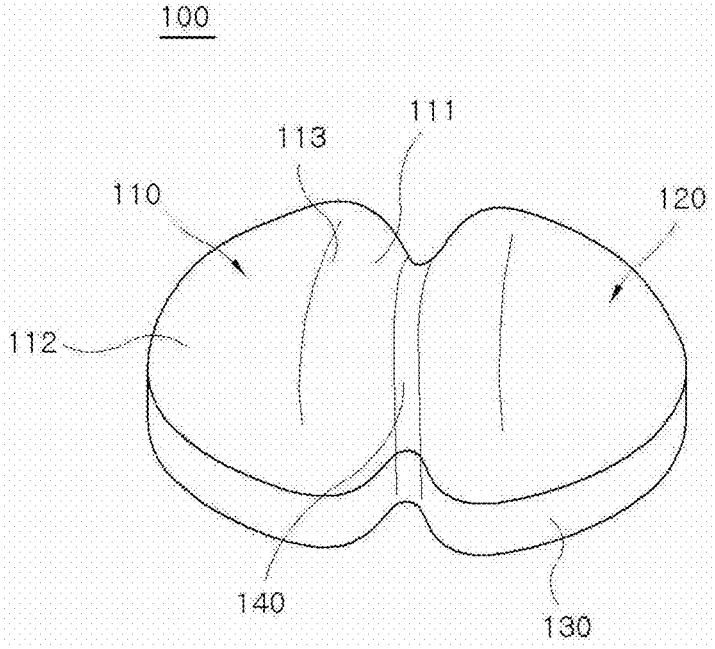
FIG. 7 is a diagram illustrating various exemplary embodiments of the diffusion lens according to an exemplary embodiment of the present invention.
Figure 8:
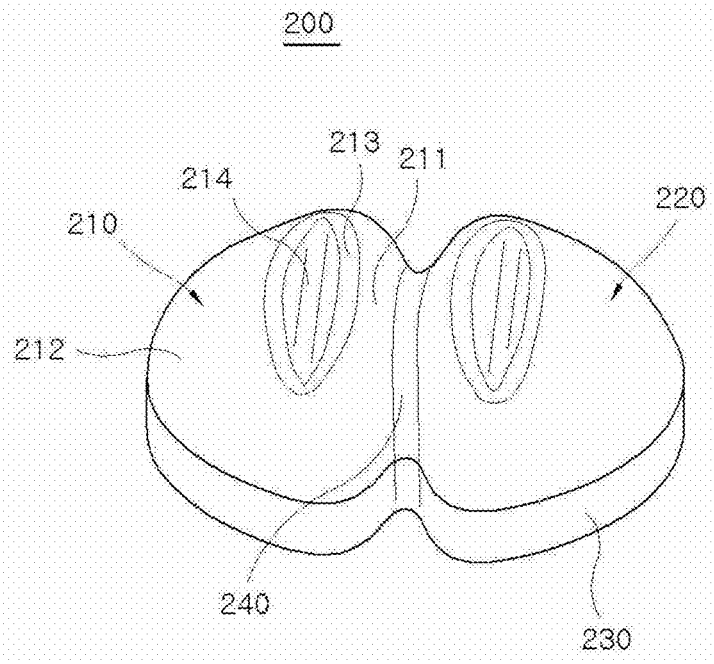
FIG. 8 is a diagram illustrating various exemplary embodiments of the diffusion lens according to an exemplary embodiment of the present invention.
Figure 9:
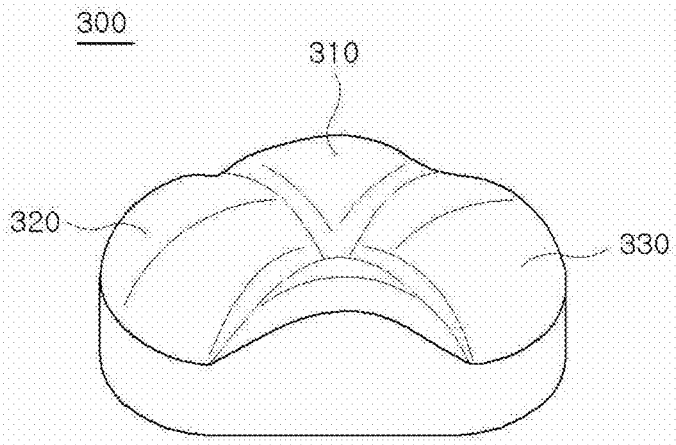
FIG. 9 is a diagram illustrating various exemplary embodiments of the diffusion lens according to an exemplary embodiment of the present invention.

FIG. 7 illustrates various exemplary embodiments of a diffusion lens for a lamp according to an exemplary embodiment of the present invention, FIG. 8 illustrates various exemplary embodiments thereof, and FIG. 9 illustrates various exemplary embodiments thereof.

Figure 10:
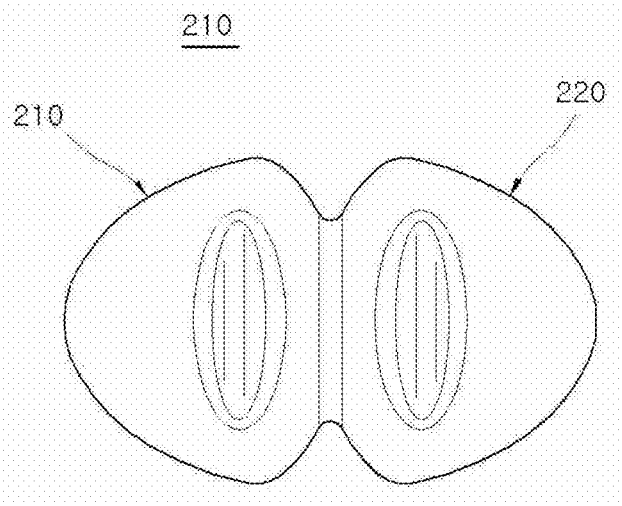
FIG. 10 is a diagram illustrating a planar shape of the various exemplary embodiments of the diffusion lens according to an exemplary embodiment of the present invention.
Figure 11:
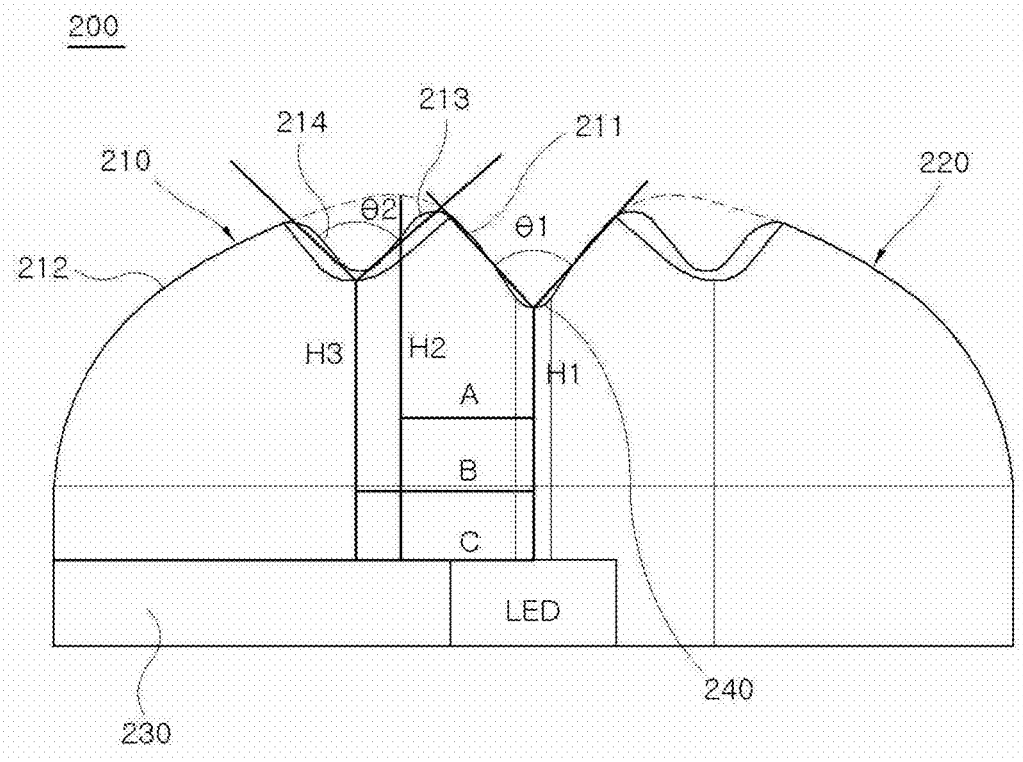
FIG. 11 is a diagram illustrating a side sectional shape of the various exemplary embodiments of the diffusion lens according to an exemplary embodiment of the present invention.

In addition, FIG. 10 illustrates a planar shape of the various exemplary embodiments of the present invention, and FIG. 11 illustrates a side sectional shape of the various exemplary embodiments.

The various exemplary embodiments of the diffusion lens according to an exemplary embodiment of the present invention will be first described with reference to FIG. 7, FIG. 8, FIG. 9, FIG. 10, and FIG. 11, and the various exemplary embodiments will be described, and the same configurations applied to the various exemplary embodiments will be described in more detail through the various exemplary embodiments.

The diffusion lens according to an exemplary embodiment of the present invention includes a plurality of base portions which are formed by injection on the LED 12 and the PCB substrate 11, and contact with the PCB substrate 11, and a plurality of diffusion portions which correspond to the upper portion of the base portion and have a convex surface which is symmetrical with respect to the optical axis which is a straight direction of the light emitted from the LED 12. The base portion is a configuration considering the height of the LED 12, but may be omitted.

First, the diffusion lens 100 according to the various exemplary embodiments of FIG. 7 is formed to have a structure in which the base portion 130, which contacts with the PCB substrate 11, and the diffusion portions 110, 120, which have the convex surfaces, are symmetrical to each other with respect to the optical axis.

However, the convex surfaces of the diffusion portions 110, 120 are not formed of curved surfaces having a single curvature, but are formed of two or more curved surfaces having different centers of curvatures, such that each diffusion portion has an asymmetric and aspheric shape.

That is, the convex surface of the diffusion portion may be formed of a first curved surface 111, a second curved surface 112, and a third curved surface 113.

The first curved surface 111 is close to the optical axis, the second curved surface 112 is mounted far from the optical axis, and the third curved surface 113 is formed between the first curved surface 111 and the second curved surface 112.

The first curved surface 111, the second curved surface 112, and the third curved surface 113 may have different centers of curvatures from each other, but the curved directions are configured in all the same.

In addition, the first curved surface 111, the third curved surface 113, and the second curved surface 112 are sequentially formed to be connected in order in one direction from the optical axis, and the third curved surface 113 may be ignored based on the curvature settings of the first curved surface 111 and the second curved surface 112. That is, the curvature of the third curved surface 113 may be the same as the curvature of the first curved surface 111 or the second curved surface 112, the curvature of the second curved surface 112.

However, it is more preferable that the curvature of the third curved surface 113 is greater than the curvatures of the first curved surface 111 and the second curved surface 112, and it is more preferable that the curvature of the first curved surface 111 is smaller than the curvature of the second curved surface 112.

Furthermore, a first curved surface of the diffusion portion neighboring to the first curved surface 111 are connected by an inflection surface 140, and the inflection surface 140 has the curvature opposite to the first curved surface 111. That is, the first curved surface 111 is convex whereas the inflection surface 140 has a concaved curvature.

More detailed geometric description of such a diffusion lens according to the various exemplary embodiments is included in the geometric description of the diffusion lens according to the various exemplary embodiments of the present invention, which will be described later.

Next, a diffusion lens 200 according to the various exemplary embodiments of the present invention, which is illustrated in FIGS. 8, 10, and 11, is formed to have a structure in which a base portion 230, which contacts with the PCB substrate 11, and diffusion portions 210, 220, which have convex surfaces are symmetrical to each other with respect to the optical axis.

However, the convex surfaces of the diffusion portions 210, 220 are not formed of the curved surfaces having a single curvature, but are formed of two or more curved surfaces having different centers of curvatures, such that each diffusion portion has an asymmetric and aspheric shape.

That is, the convex surface of the diffusion portion may be formed of a first curved surface 211, a second curved surface 212, and a third curved surface 213.

Since the properties of the first curved surface 211, the second curved surface 212, the third curved surface 213, and an inflection surface 240 are the same as those of the various exemplary embodiments described above, the description thereof will be omitted.

However, a concave cut surface 214 is formed on the diffusion portion 210 of the diffusion lens 200 according to the various exemplary embodiments.

As illustrated, the concave cut surface 214 is formed to have the curvature opposite to these curved surfaces between the first curved surface 211 and the third curved surface 213, being formed concavely in a substantially V shape in a side surface as illustrated.

The concave cut surface 214 may be a concave shape which is smoother than the V shape, a plurality of concave cut surfaces 214 may also be formed, and at this time, the inflection surface 240 may also be regarded as one concave cut surface 214.

In the instant case, the plurality of concave cut surfaces 214 may be sequentially formed of the concave surfaces having the same shape as each other, that is, in a parallel relationship with each other.

Alternatively, neighboring concave cut surfaces 214 may be implemented in surface symmetrical to each other, and the concave cut surface 214 may be implemented in an asymmetrical shape as a whole.

Next, the geometrical feature of the diffusion lens according to the various exemplary embodiments will be described with reference to FIG. 11. Here, the geometrical feature is also applied equally to the diffusion lens according to the various exemplary embodiments except for the items related to the concave cut surface, and the surface light emission suitable effects to be described later may be exerted by such a geometrical shape of the diffusion lens.

In FIG. 11, the H1 refers to the height from the LED to the lowest point of the inflection surface 240, the H2 refers to the height from the LED to the highest point of the convex surface, and the H3 refers to the height from the LED to the lowest point of the concave cut surface 214.

In addition, the refers to the horizontal distance from the LED to the highest point (H2), the B refers to the horizontal distance from the LED to the concave cut surface (H3), and the C refers to the horizontal distance from the LED to the end portion of the second curved surface 212.

Here, the H2 is higher than the H1, and may have a range of H1:H2=1:1 to 2.

In addition, the H3 is higher than or equal to the H1.

In addition, A:C has a ratio of 1:2 to 4 or less, and B:C has a ratio of about 1:2 or less.

The angle of the concave portion which is formed between both diffusion parts, that is, the angle (θ1) between the highest points of both the diffusion portions with respect to the lowest point of the inflection surface 240 is about 6 to 70 degrees, and the angle of the concave cut surface 214, that is, the angle (θ2) between the highest point of the diffusion portion and the highest point of the second curved surface 212 with respect to the lowest point of the concave cut surface 214 is about 7 to 80 degrees.

As described above, the concave portion and the V-cut end portion are needed to have an R value, and when viewed from the top portion as in FIG. 10, the optic is formed concavely in the vertical direction of the LED to send the LED light which is emitted vertically to 120 degrees in the left and right direction thereof. In addition, when viewed from the side as in FIG. 8, the V cut may be formed in the vicinity of the center of the convex surface, diffusing the light quantity to the center portion thereof.

Next, FIG. 9 illustrates a diffusion lens 300 according to various exemplary embodiments of the present invention. The diffusion lens 300 according to the various exemplary embodiments includes a plurality of diffusion portions 310, 320, 330 having convex surfaces on concentric circles with respect to the optical axis like the diffusion lenses according to the various exemplary embodiments.

However, unlike the aforementioned embodiments, each of the diffusion portions 310, 320, 330 has a single curvature, includes four diffusion portions symmetrically, and is partially omitted in the drawing.

Figure 12:
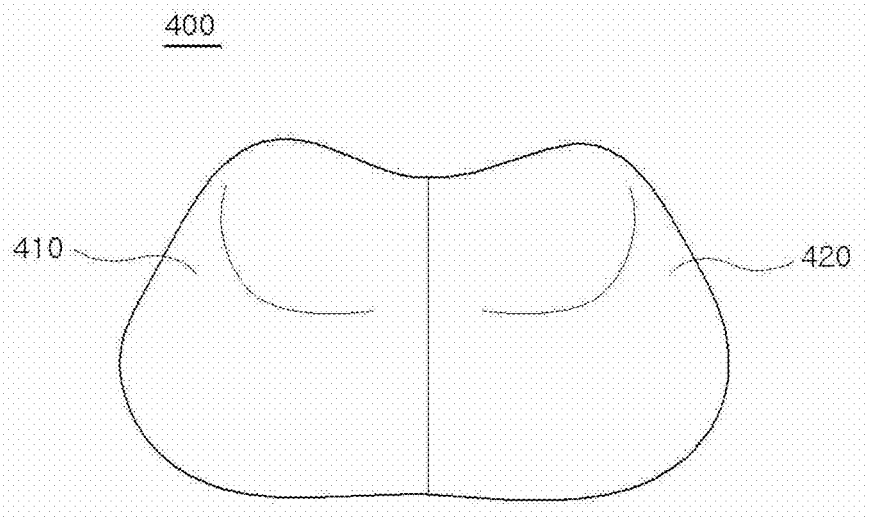
FIG. 12 is a diagram illustrating a diffusion lens according to a Comparative Example.

Next, FIG. 12 illustrates a Comparative Example 1 which includes the diffusing parts 410, 420 having the symmetrical and convex surfaces with respect to the optical axis by simulating the diffusing lens according to the various exemplary embodiments of the present invention.

Figure 13:
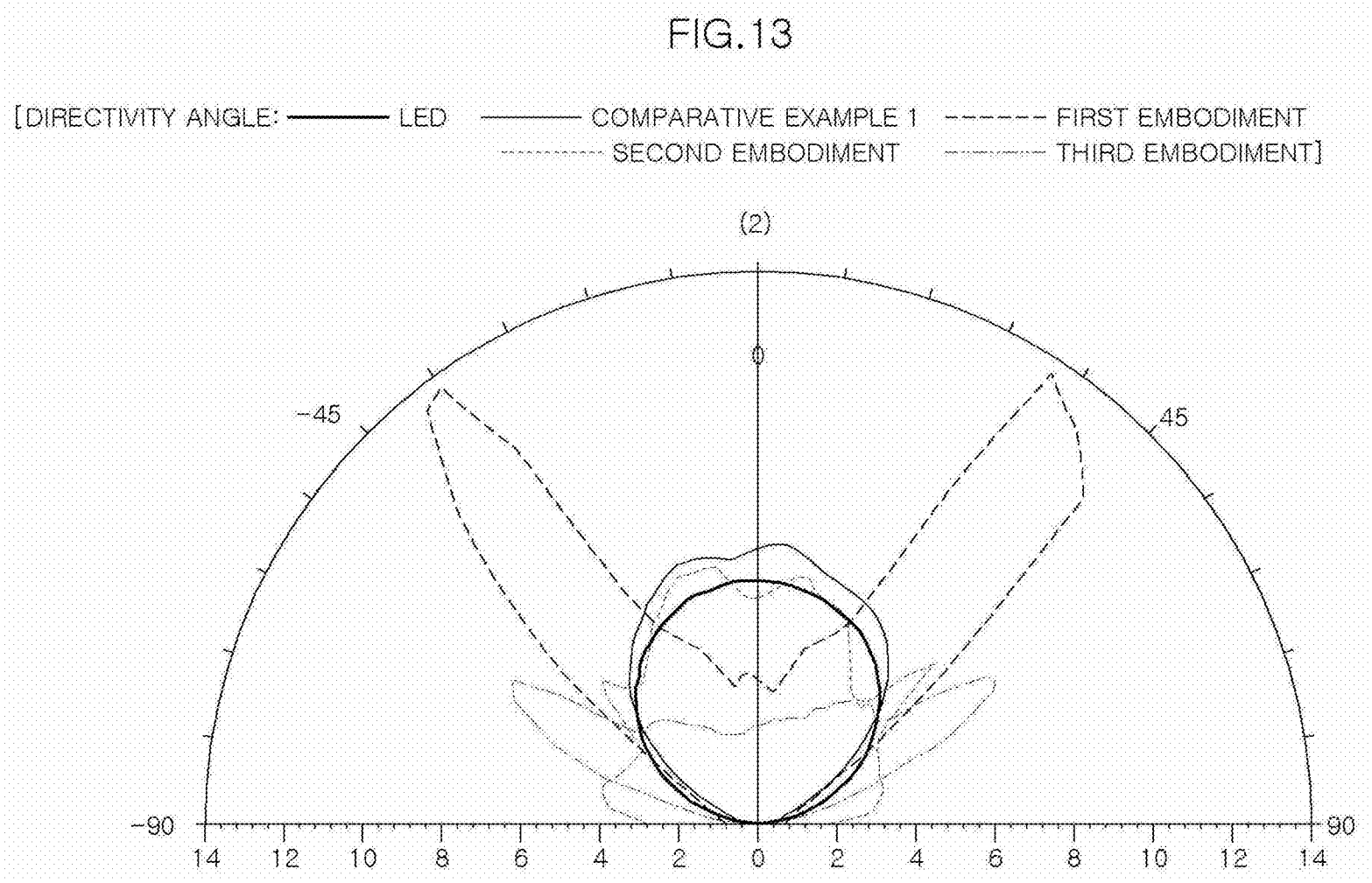
FIG. 13 and FIG. 14 are diagrams illustrating directivity angles according to the Comparative Example and first to various exemplary embodiments of the present invention.
Figure 14:
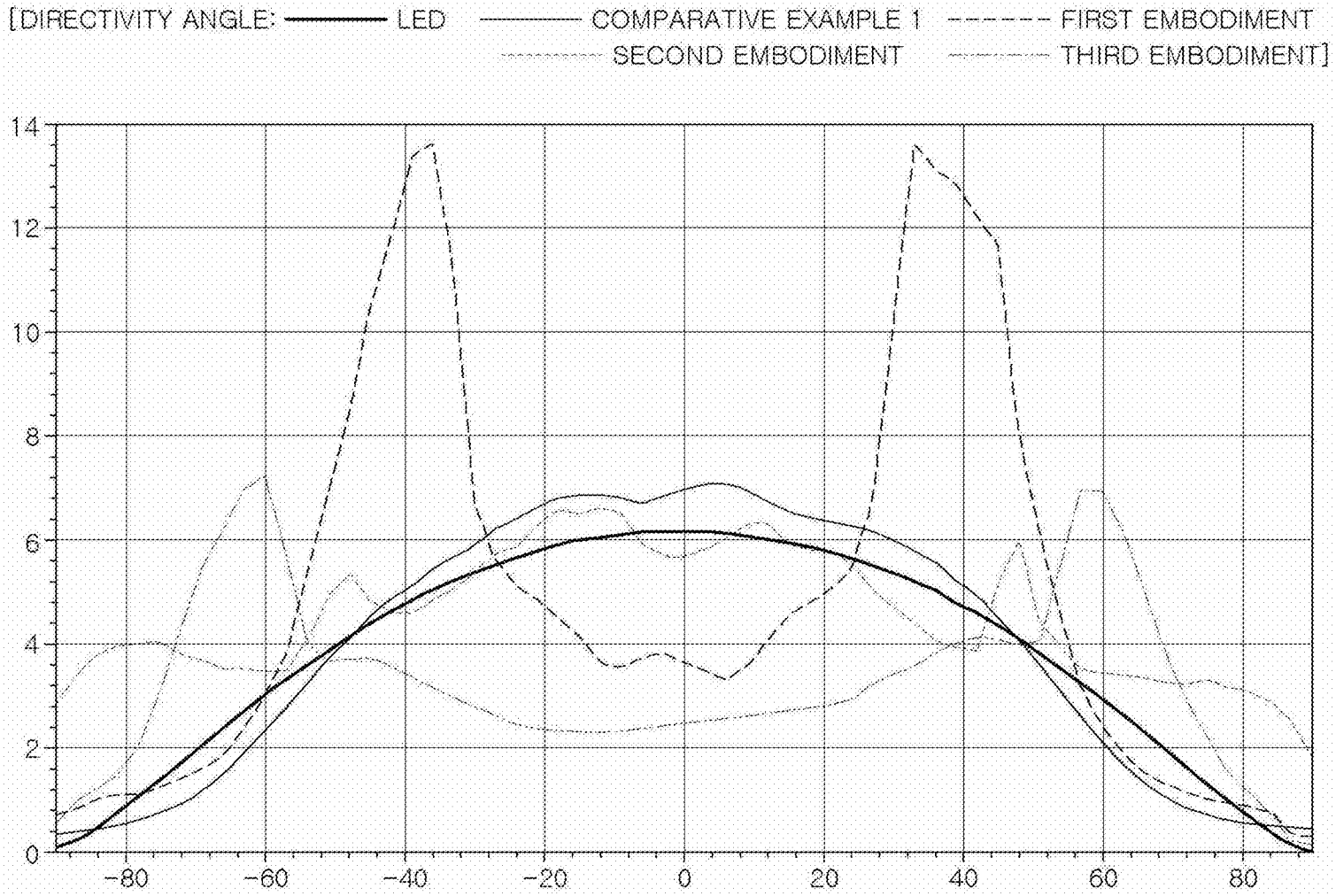
Figure 15A:
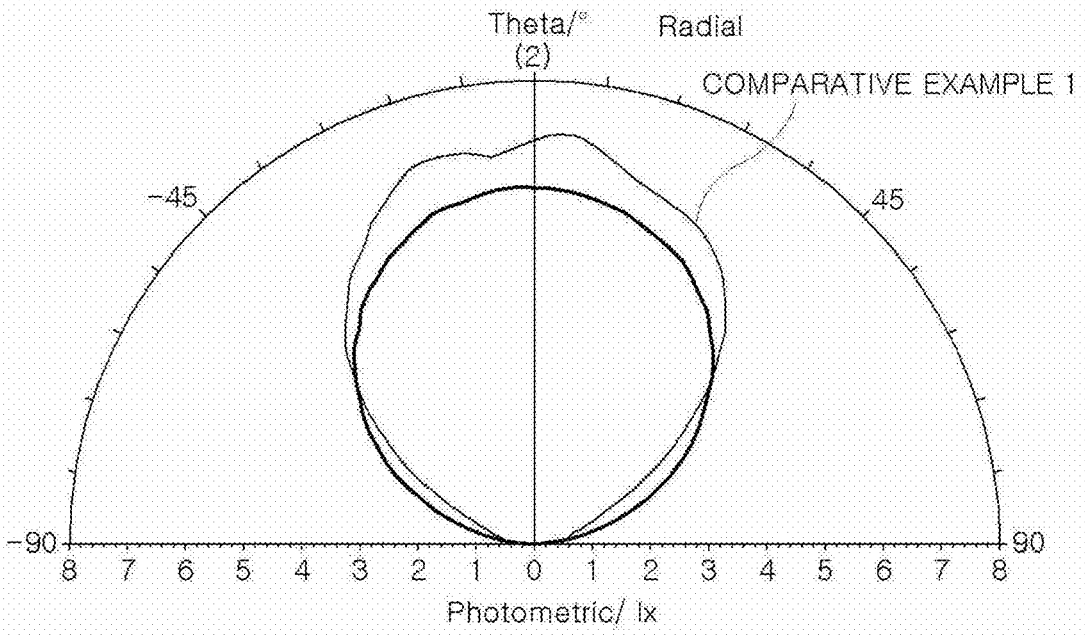
FIG. 15A, FIG. 15B, FIG. 15C and FIG. 15D are diagrams sequentially illustrating the directivity angles according to the Comparative Example and first to various exemplary embodiments of the present invention.
Figure 15B:
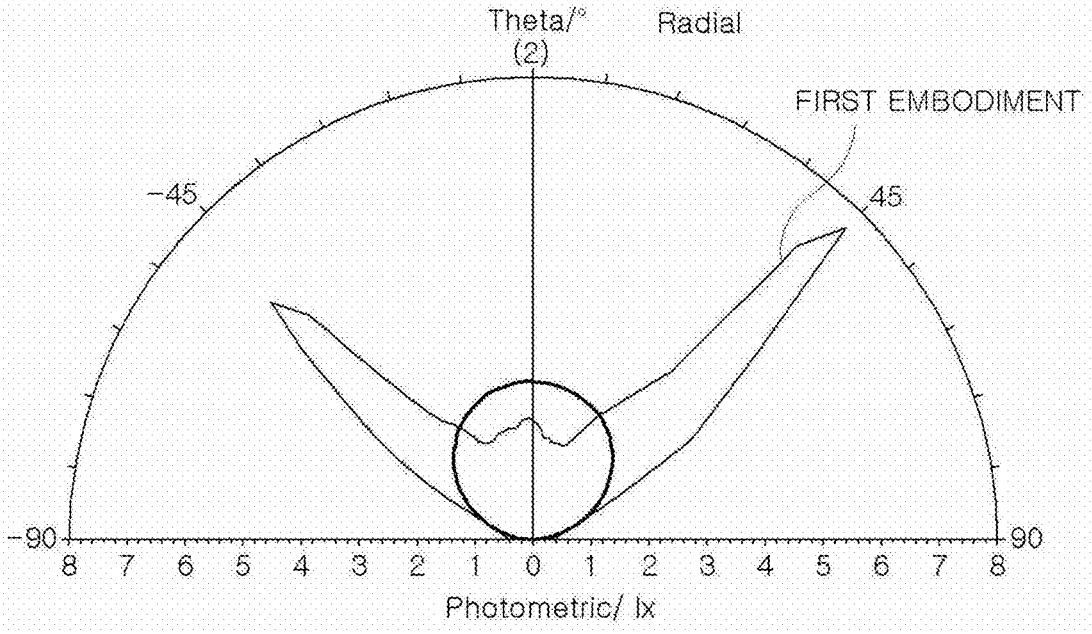
Figure 15C:
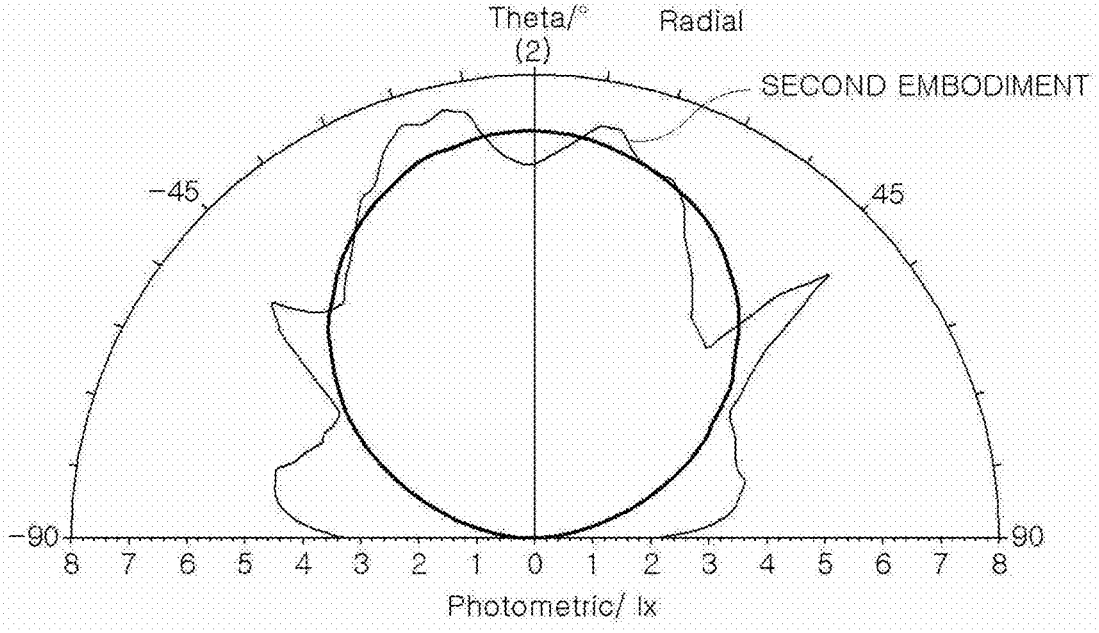
Figure 15D:
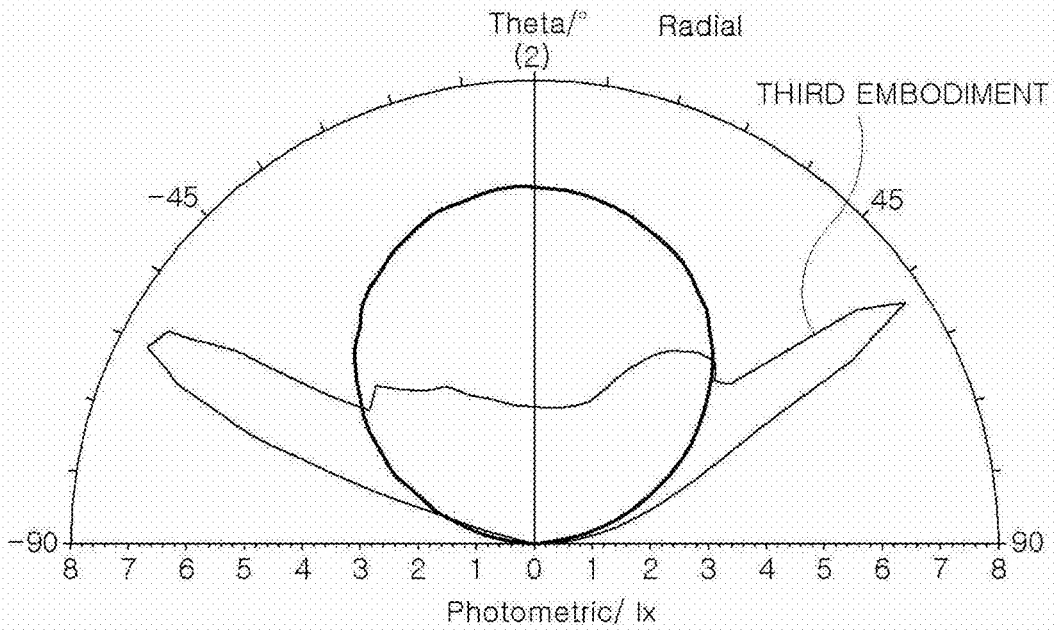

In addition, FIG. 13 and FIG. 14 illustrate the directivity angles according to the Comparative Example and first to various exemplary embodiments of the present invention.

FIG. 15A, FIG. 15B, FIG. 15C and FIG. 15D sequentially illustrate the directivity angles according to the Comparative Example and first to various exemplary embodiments of the present invention, and FIG. 16A, FIG. 16B, FIG. 16C and FIG. 16D sequentially illustrate simplified lamp images according to the Comparative Example and first to various exemplary embodiments of the present invention.

Next, the effects of the Comparative Example 1, the various exemplary embodiments of the present invention, the various exemplary embodiments of the present invention, and the various exemplary embodiments will be described with reference to the following BRIEF SUMMARY in Table 1.

TABLE 1

| | A:C | B:C | H1:H2 | H1:H3 | θ1 | θ2 | Highest brightness | Highest brightness angle | Directivity angle (50% of highest brightness) | | |
|---|---|---|---|---|---|---|---|---|---|---|---|
| LED | — | — | — | | — | — | 6 | 0 | 60 | — | — |
| Comparative Example 1 | 1:2 | — | — | | 120 | — | 7 | 6 | 50 | — | — |
| Various exemplary embodiments | 1:4 | — | 1:1.7 | — | 65 | — | 13.6 | 33 | 50 | 30 | — |
| Various exemplary embodiments | 1:4 | 1:2.7 | 1:1.7 | H1 ≤ H3 | 65 | 80 | 6.6 | 12 | 87 | 66 | 57 |
| Various exemplary embodiments | 1:2 | — | 1:2 | — | — | — | 7.6 | 57 | 65 | 30 | — |

Figure 16A:
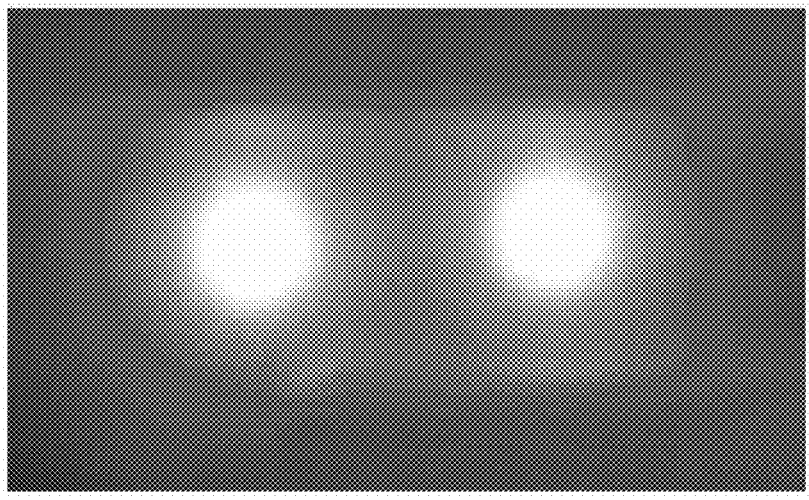
FIG. 16A, FIG. 16B, FIG. 16C and FIG. 16D are diagrams sequentially illustrating simplified lamp images according to the Comparative Example and first to various exemplary embodiments of the present invention.

In the case of the Comparative Example 1 in which the θ1 is 90 degrees or Moreover, as in the simplified lamp image of FIG. 16A, the light is collected at the center portion and the light does not spread in the left and right direction thereof. In addition, as may be confirmed in Table 1, the directivity angle is 50 degrees, and is an angle which is reduced as compared to the existing LED directivity angle (60 degrees). This is a phenomenon where the light of the LED is concentrated in the center portion.

Figure 16B:
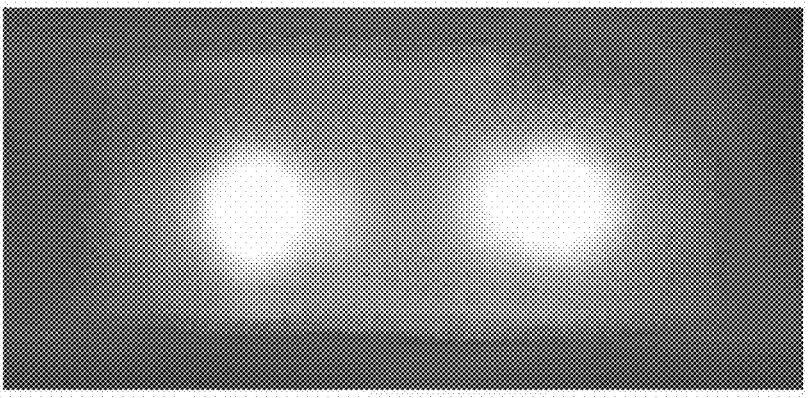
Figure 16C:
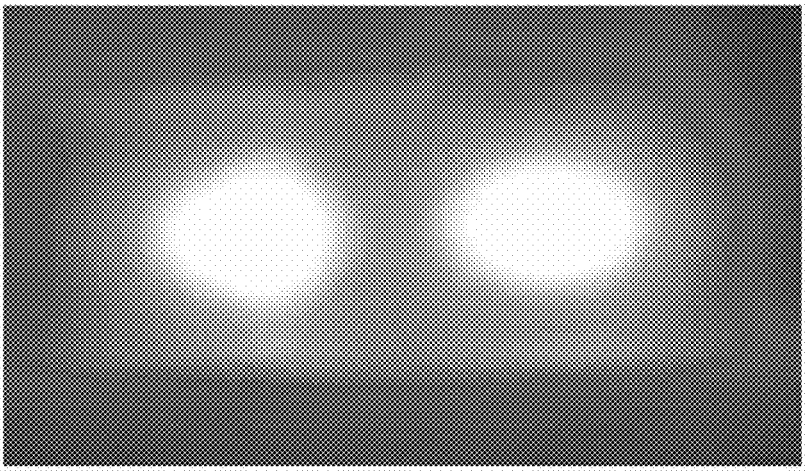
Figure 16D:
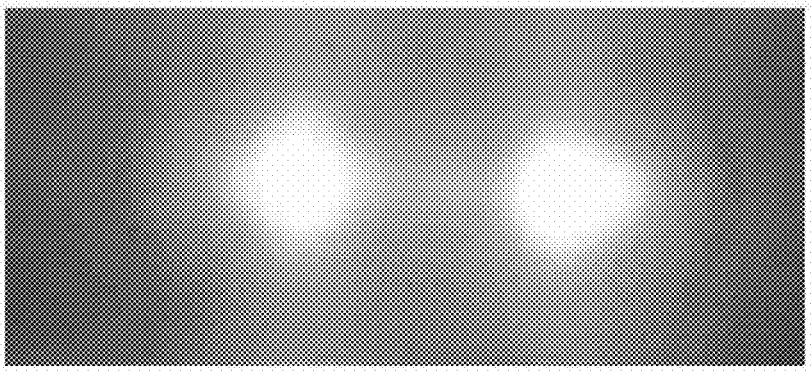

However, each of the first, second, and various exemplary embodiments of the present invention where the θ1 is 90 degrees or less prove the light diffusion effects as in FIGS. 16B to 16D.

That is, the diffusion lens according to an exemplary embodiment of the present invention is superior in the light diffusion performance to the lens of the related art, and has no air gap, such that the optical loss due to the air gap is less and the highest brightness is higher than the existing LED light amount as in Table 1.

Unlike the Comparative Example 1 which had only one directivity angle, it may be seen that the present invention has a plurality of directivity angles and diffuses light at various angles. As may be confirmed in Table 1, the various exemplary embodiments has three directivity angles of 87, 66, 57, which means that the light is diffused horizontally at an angle higher than that of the Comparative Example 1. This allows the use of a small number of LEDs in vehicle lamp components and allows for implementing the uniform linear image.

The related art has a smooth mountain shape when the angle (θ1) of the concave portion is 90 degrees or Moreover, and a ratio of the A:C, which is the location of the highest point in the lens, is 1:3 or more as in the Comparative Example 1, preventing the light from being diffused to the left and right direction thereof. Accordingly, the Comparative Example 1 may not diffuse the light widely at an angle of 120 degrees of the circular shape which is the shape of the existing directivity angle of the LED.

On the other hand, the light is emitted in the light amount concentrated form around ±40 degrees when the angle (θ1) of the concave portion is 90 degrees or less, and a ratio of A:C, which is the location of the highest point in the lens, is 1:3 or less as in the various exemplary embodiments. Accordingly, the lens according to the various exemplary embodiments may reduce the light amount of the vertical portion of the LED and widely diffuse the light in the left and right direction thereof.

In addition, the various exemplary embodiments has a form of increasing the light amount at the ±10, ±40, and ±80 locations of the directivity angle in a form of forming the concave cut surface at the highest point of the various exemplary embodiments. The various exemplary embodiments maximally diffuses the light at the horizontal angle and widely diffuses the light while widely spreading the exiting circular directivity angle of 120 degrees to various angles. This may improve the image by improving the light uniformity in the vehicle lamp, and may also reduce the number of the LEDs.

Finally, the various exemplary embodiments diffuses the light in a form of a cross by forming the convex parts at four places concentrically and symmetrically rather than two places. This also diffuses the light in the left and right direction by spreading the light wider than the existing directivity angle. It is difficult to confirm the vertical direction in the directivity angle graph.

Figure 17:
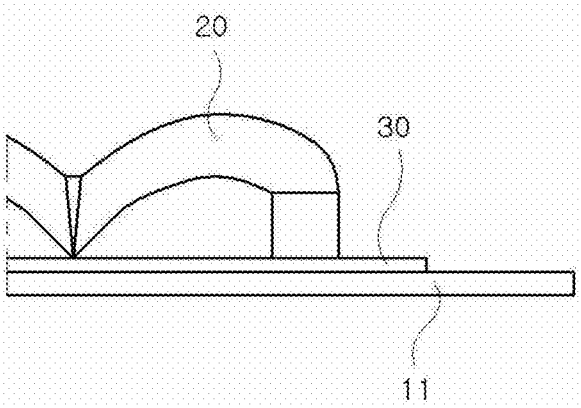
FIG. 17 is a diagram schematically illustrating a diffusion lens according to an Application Example of the present invention.

In addition, unlike the related art, the present invention may have one lens per one LED to diffuse the maximum LED light per one LED, reducing the number of the LEDs. In addition, there is no need for fastening by injecting the diffusion lens at once through the silicon injection process and there exists no air gap, such that there is little optical loss. Meanwhile, as in FIG. 17, a thin adhesive layer 30 having 0.5 mm to 2.0 mm may be formed between the diffusion lens 20 and the PCB substrate 11 by injection, improving the adhesive force between the lens and the PCB substrate and being applicable to the lamp having a curvature.

In addition, the diffusion lens according to an exemplary embodiment of the present invention may include a silicon material to have the excellent elasticity and the strong adhesive force, exerting the excellent performance as the diffusion lens of the lamp having the curvature.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A diffusion lens comprising a plurality of diffusion portions which is symmetrical to each other with respect to an optical axis which is a straight direction of a light emitted from a light-emitting diode (LED), and has convex surfaces, wherein the convex surfaces of the diffusion portions include a first curved surface and a second curved surface which have different centers of curvatures, and a third curved surface between the first curved surface and the second curved surface, and are formed to be sequentially connected in a direction in an order of the first curved surface, the third curved surface, and the second curved surface from the optical axis.

2. The diffusion lens of claim 1, wherein the curvature of the third curved surface is greater than the curvature of the first curved surface and the curvature of the second curved surface.

3. The diffusion lens of claim 1, wherein the curvature of the first curved surface is smaller than the curvature of the second curved surface.

4. The diffusion lens of claim 1, wherein an inflection surface, which is formed between the first curved surface of one of the diffusion portions and the first curved surface of another of the diffusion portions neighboring to the first curved surface of the one of the diffusion portions, and has a curvature opposite to the first curved surface of the one of the diffusion portions, is formed.

5. The diffusion lens of claim 4, wherein an angle between highest points of the one and another of the diffusion portions around a lowest point of the inflection surface is 5 degrees to 80 degrees.

6. The diffusion lens of claim 4, wherein a height from the LED to a lowest point of the inflection surface and a height from the LED to a highest point of the diffusion portions are in a ratio of 1:1 to 2.

7. The diffusion lens of claim 4, wherein a horizontal distance from the LED to a highest point of the diffusion portions and a horizontal distance from the LED to an end portion of the second curved surface are in a ratio of 1:1 to 4.

8. The diffusion lens of claim 1, wherein the convex surfaces of the diffusion portions further include:

a concave cut surface which has a curvature opposite to the first curved surface and the third curved surface between the first curved surface and the third curved surface.

9. The diffusion lens of claim 8, wherein an inflection surface, which is formed between a first curved surface of one of the diffusion portions, and a first curved surface of another of the diffusion portions neighboring to the first curved surface of the one of the diffusion portions, and has a curvature opposite to the first curved surface of the one of the diffusion portions, is formed.

10. The diffusion lens of claim 9, wherein an angle between highest points of adjacent respective diffusion portions around a lowest point of the inflection surface is 5 degrees to 80 degrees.

11. The diffusion lens of claim 9, wherein a height from the LED to a lowest point of the inflection surface and a height from the LED to a highest point of the diffusion portions are in a ratio of 1:1 to 2.

12. The diffusion lens of claim 9, wherein a horizontal distance from the LED to a highest point of the diffusion portions and a horizontal distance from the LED to an end portion of the second curved surface are 1:1 to 4.

13. The diffusion lens of claim 9, wherein an angle between the highest point of the diffusion portions and the highest point of the second curved surface around a lowest point of the concave cut surface is 7 degrees to 80 degrees.

14. The diffusion lens of claim 9, wherein a height from the LED to a lowest point of the concave cut surface is equal to or more than a height from the LED to a lowest point of the inflection surface.

15. A lamp comprising:

a printed circuit board (PCB) substrate;

a light-emitting diode (LED) mounted to the PCB substrate; and a diffusion lens including a plurality of diffusion portions, which is symmetrical to each other with respect to an optical axis which is a straight direction of a light emitted from the LED, and has convex surfaces, wherein the convex surfaces of the diffusion portions include a first curved surface and a second curved surface which have different centers of curvatures, and a third curved surface between the first curved surface and the second curved surface, and are formed to be sequentially connected in a direction in an order of the first curved surface, the third curved surface, and the second curved surface from the optical axis.

16. The lamp of claim 15, wherein material of the diffusion lens is a liquid silicone material (LSR).

17. The lamp of claim 16, wherein an air gap does not exist between the diffusion lens and the LED.

18. The lamp of claim 16, wherein the diffusion lens is formed integrally on the PCB substrate by injection.

* * * * *